US007792629B2

(12) United States Patent
Sczomak et al.

(10) Patent No.: US 7,792,629 B2
(45) Date of Patent: Sep. 7, 2010

(54) HIGH PRESSURE PUMP ACTUATION IN A VEHICLE

(75) Inventors: David P. Sczomak, Troy, MI (US); Jesse M. Gwidt, Brighton, MI (US); Stuart R. Smith, Howell, MI (US)

(73) Assignee: GM Global Technology Operations, Inc.

( * ) Notice: Subject to any disclaimer, the term of this patent is extended or adjusted under 35 U.S.C. 154(b) by 347 days.

(21) Appl. No.: 11/959,773

(22) Filed: Dec. 19, 2007

(65) Prior Publication Data

US 2009/0164093 A1 Jun. 25, 2009

(51) Int. Cl.
*F02D 41/00* (2006.01)
*F02M 39/02* (2006.01)

(52) U.S. Cl. ..... 701/103; 123/446

(58) Field of Classification Search ..... 123/446, 123/445, 447, 452, 456, 457, 458, 496, 506; 701/103; 74/569
See application file for complete search history.

(56) References Cited

U.S. PATENT DOCUMENTS 2,419,542 A * 4/1947 Dreisin et al. ..... 417/461
4,762,096 A * 8/1988 Kamm et al. ..... 123/90.16
5,287,830 A * 2/1994 Dopson et al. ..... 123/90.16
5,343,833 A * 9/1994 Shirai ..... 123/90.16
5,361,733 A * 11/1994 Spath et al. ..... 123/90.16
5,603,294 A * 2/1997 Kawai ..... 123/90.16
5,709,180 A * 1/1998 Spath ..... 123/90.16
6,113,361 A * 9/2000 Djordjevic ..... 417/383
2004/0101418 A1* 5/2004 Roth et al. ..... 417/221
2005/0132989 A1* 6/2005 Hendriksma et al. ..... 123/90.16
2008/0115770 A1* 5/2008 Merchant ..... 123/508
2009/0107434 A1* 4/2009 Berger ..... 123/90.31
2009/0164093 A1* 6/2009 Sczomak et al. ..... 701/103

* cited by examiner

*Primary Examiner*—Stephen K Cronin
*Assistant Examiner*—Arnold Castro

(57) ABSTRACT

A drive system comprises a shaft in rotational engagement with a crankshaft of an engine, the shaft including a first cam having a first quantity of lobes; and a second cam having a second quantity of lobes greater than the first quantity of lobes; and a selection mechanism to selectively engage a follower to one of the first cam or the second cam. A method comprises rotating a shaft having a first cam and a second cam; monitoring operating parameters of a vehicle; operating a fuel pump of the vehicle at a desired capacity based on the monitoring, including selectively engaging the fuel pump to one of the first cam and the second cam.

23 Claims, 5 Drawing Sheets

HIGH PRESSURE PUMP ACTUATION IN A VEHICLE

FIELD

The present disclosure relates to fuel pumps in vehicles, and more specifically, to high pressure fuel pumps in vehicles.

BACKGROUND

The statements in this section merely provide background information related to the present disclosure and may not constitute prior art.

Vehicles may utilize a fuel pump to provide fuel to be combusted during operation of an engine. A fuel pump used to provide fuel to an engine may be a piston pump. The piston pump may be driven by a crankshaft output through a chain gear and cam.

In some vehicle operating conditions a requested fuel supply may exceed the capacity of a fuel pump configuration. For example, at vehicle cold start it may be desired to provide additional fuel to the combustion chamber. Increased fuel at cold start may be used with fuels such as ethanol blends, an example of which is an 85% blend of ethanol (E85). Another example of an operating condition requiring an increased fuel supply may be a heavy load where more fuel is required to power the engine.

In some vehicle operating conditions, the piston pump operation may not be optimal. For example, at high engine speeds the piston and cam may fail to engage properly. In such a "no-follow" condition the piston of the fuel pump may not stroke properly.

SUMMARY

A drive system comprises a shaft in rotational engagement with a crankshaft of an engine, the shaft including a first cam having a first quantity of lobes; and a second cam having a second quantity of lobes greater than the first quantity of lobes; and a selection mechanism to selectively engage a follower to one of the first cam or the second cam.

A method comprises rotating a shaft having a first cam and a second cam; monitoring operating parameters of a vehicle; operating a fuel pump of the vehicle at a desired capacity based on the monitoring, including selectively engaging the fuel pump to one of the first cam and the second cam.

A control module comprises an operating mode determination module monitoring operating parameters of a vehicle and determining a capacity of a fuel pump; and a fuel pump mode selection module in communication with the operating mode determination module to selectively engage the fuel pump to one of a first cam and a second cam.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way. The present teachings will be become more fully understood from the detailed description and the accompanying drawings, wherein.

DETAILED DESCRIPTION

Figure 1:
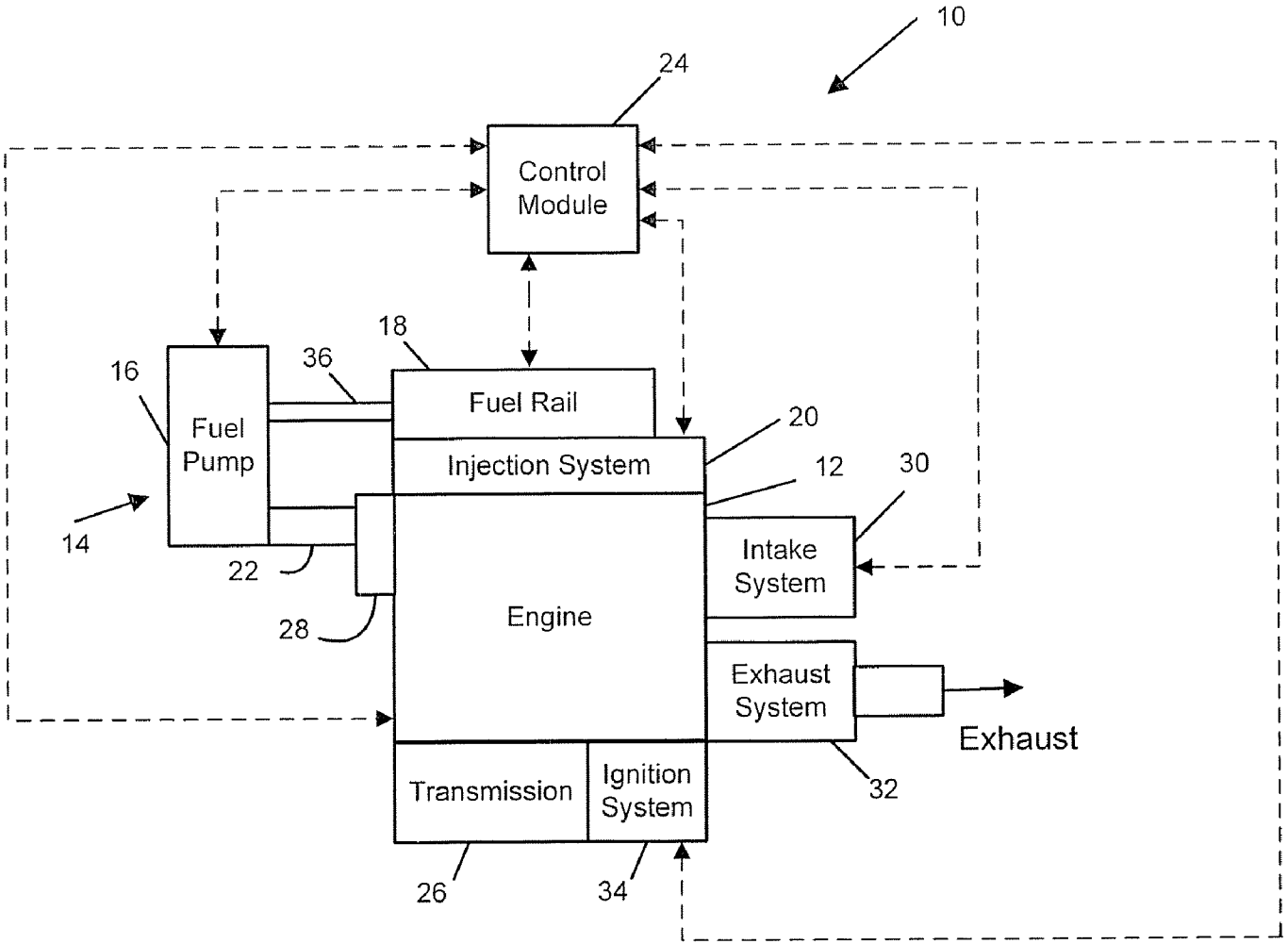
FIG. 1 is a schematic illustration of an exemplary powertrain.

The following description is merely exemplary in nature and is in no way intended to limit the present teachings, applications, or uses. For purposes of clarity, the same reference numbers may be used in the drawings to identify similar elements. As used herein, the term module refers to an application specific integrated circuit (ASIC), an electronic circuit, a processor (shared, dedicated or group) and memory that execute one or more software or firmware programs, a combination of logic circuits, or other suitable components that provide the described functionality.

Referring now to FIG. 1, an exemplary vehicle 10 is schematically illustrated. Vehicle 10 may include engine 12, which may be in communication with fuel system 14, intake system 30, ignition system 34, exhaust system 32, coupling 28 and transmission 26. Fuel system 14 may include fuel pump 16, fuel rail 18, injection system 20, two-step cam mechanism 22, and fuel line 36. Two-step cam mechanism 22 may be in communication with coupling 28. Control module 24 may be in communication with engine 12, fuel pump 16, fuel rail 18, injection system 20, intake system 30, and ignition system 34. Engine 12 may be a spark ignition direct injection (SIDI) engine. A SIDI engine 12 may require high pressure fuel for direct injection. Although the following description includes a SIDI engine, it should be recognized that this description may apply to any engine 12 that utilizes a fuel pump 16.

Engine 12 may have access points through which fuel may be injected into a combustion chamber of engine 12. Fuel may be provided by fuel system 14 and intake system 30 may provide air to engine 12. The location of the fuel injection points may allow engine 12 to operate with a lean fuel-to-air mixture in comparison to conventional engines without direct fuel injection. Ignition system 34 may provide a spark to ignite the fuel and air mixture in engine 12. When operated in this manner, engine 12 may produce an output power equivalent to conventional engine while using less fuel.

Coupling 28 may engage two-step cam mechanism 22 to the crankshaft (not pictured) of engine 12. Alternatively, the two-step cam mechanism 22 may be directly driven by the engine camshaft (not pictured) or by placing the pump cam actuation cams on an engine camshaft (not pictured). Coupling 28 may be any system that transfers rotational energy to two-step cam mechanism 22 from the crankshaft or camshaft of engine 12. Two-step cam mechanism 22 may be a shaft having two or more cams with two or more lobe profiles, as will be described in more detail below. Two-step cam mechanism 22 or fuel pump 16 may include a cam follower that may selectively engage a cam of two-step cam mechanism 22 to provide power to fuel pump 16, which may be a piston pump. Fuel pump 16 may provide high pressure fuel to fuel rail 18 through fuel line 36. Fuel rail 18 may deliver the high pressure fuel to injection system 20 at the direct injection inputs of engine 12. Injection system 20 may provide fuel directly to the engine combustion chamber such as in an atomized spray.

Intake system 30 may provide air to engine 12 and ignition system 34 may provide a spark for ignition of the air-fuel mixture in a combustion chamber of engine 12. Combustion of the air-fuel mixture in engine 12 may produce exhaust which may exit engine 12 through exhaust system 32. Combustion of the air-fuel mixture in engine 12 may also provide power that is transferred to transmission 26.

Control module 24 may monitor, control and communicate with components of vehicle 10 including engine 12, fuel system 14, intake system 30 and ignition system 34. Control module 24 may receive measurements and status indicators, and may provide commands that control the operation of components of vehicle 10.

Figure 2:
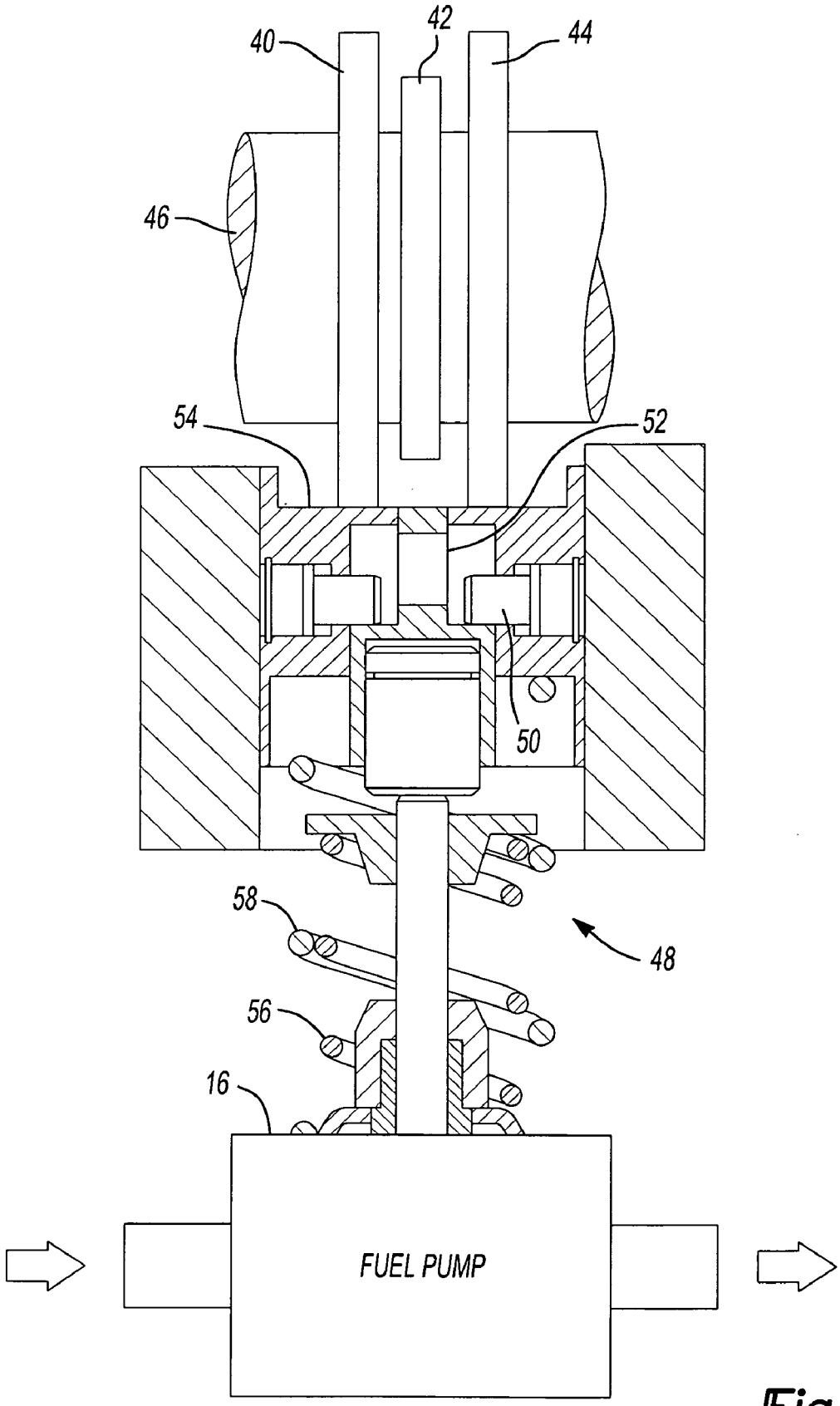
FIG. 2 is a schematic illustration of a two-step cam follower mechanism.

Referring now to FIG. 2, two-step cam mechanism 22 and fuel pump 16 are depicted in more detail. Two-step cam mechanism 22 may include shaft 46, outer cams 40 and 44, and inner cam 42. Cam follower 48 may be integral to fuel pump 16 or may be coupled to fuel pump 16. Cam follower 48 may include selection mechanism 50, inner follower 52, outer follower 54, inner spring 56 and outer spring 58. Although two-step cam mechanism 22 is depicted with two outer cams 40 and 44, and inner cam 42, it should be recognized that two-step cam mechanism 22 will operate properly with any shaft 46 having at least two cams. Shaft 46 may be drivingly engaged with coupling 28 (not shown) that transfers power from a crankshaft of engine 12 to shaft 46. Alternatively, shaft 46 may be integral with a camshaft of engine 12 or driven directly by a camshaft of engine 12. Cams 40, 42 and 44 may be affixed about shaft 46 such that cams 40, 42, and 44 rotate with shaft 46.

Follower 48 may be selectively engaged with one or more of cams 40, 42 and 44. Although follower 48 is depicted, it should be recognized that numerous follower mechanisms may be operable to select one or more of cams 40, 42, and 44. The other end of follower 48 may be engaged with a piston of fuel pump 16. Selection mechanism 50 may be a conventional hydraulic mechanism that may selectively lock inner follower 52 within outer follower 54, as depicted in FIG. 2. When inner follower 52 is locked within outer follower 54, follower 48 may translate motion to a piston of fuel pump 16 relative to the rotation of outer cams 40 and 44. When inner follower 52 is not locked within outer follower 54, follower 48 may translate motion to a piston of fuel pump 16 relative to the rotation of inner cam 42. Outer cams 40 and 44 may have a lobe profile with four lobes while inner cam 42 may have a lobe profile with two lobes. When shaft 46 rotates, follower 48 may be displaced relative to the lobe profile of the cam that follower 48 is engaged with such that a piston of fuel pump 16 completes a stroke for each lobe.

Figure 3:
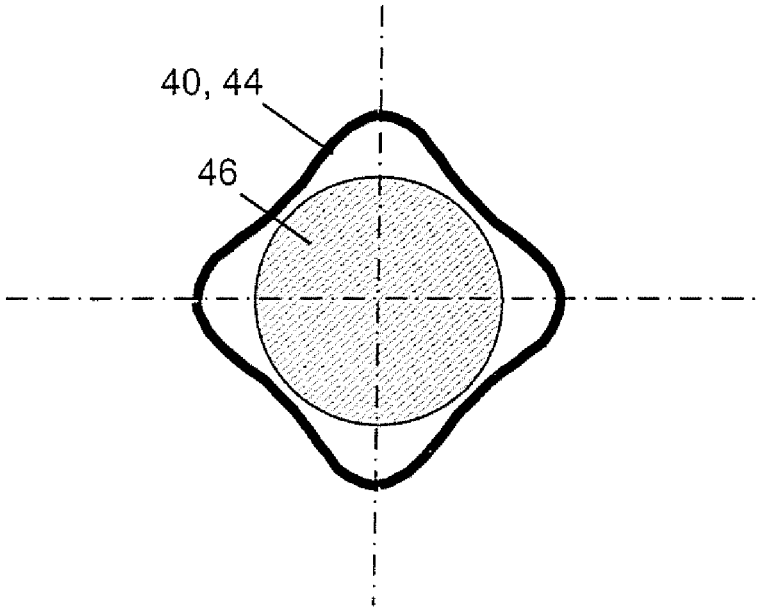
FIG. 3 is a profile view of a four-lobe cam.

Referring now to FIG. 3, a profile view of outer cams 40 and 44 about shaft 46 is depicted. Outer cams 40 and 44 may have a 4-lobe profile with each set of opposing lobes having a generally oval shape. When in communication with outer cams 40 and 44, follower 48 may be fully displaced to stroke a piston of fuel pump 48 four times for each revolution of shaft 46.

Figure 4:
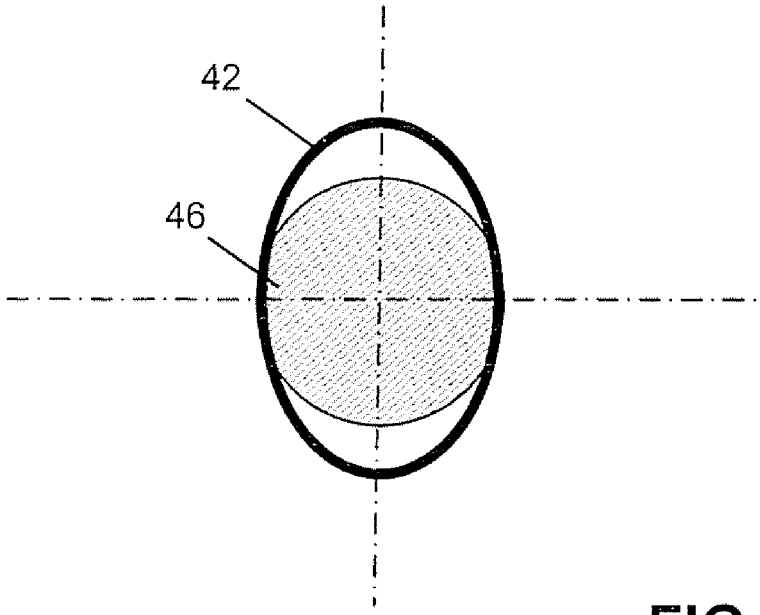
FIG. 4 is a profile view of a two-lobe cam.

Referring now to FIG. 4, a profile view of inner cam 42 about shaft 46 is depicted. Inner cam 42 may have a generally oval shape. A follower 48 in communication with inner cam 42 with a 2-lobe profile may be fully displaced to stroke a piston of fuel pump 16 twice for each revolution of shaft 46. In this manner, the differing lobe profiles of outer cams 40 and 44, and inner cam 42 may allow the capacity of fuel pump 16 to vary based on the selected cam. It should be recognized that the 4-lobe profile may be the inner cam while the 2-lobe profile may be the outer cams. It should also be recognized that different numbers of lobes and different lobe profiles may be used to stroke a piston of fuel pump 16.

Figure 5:
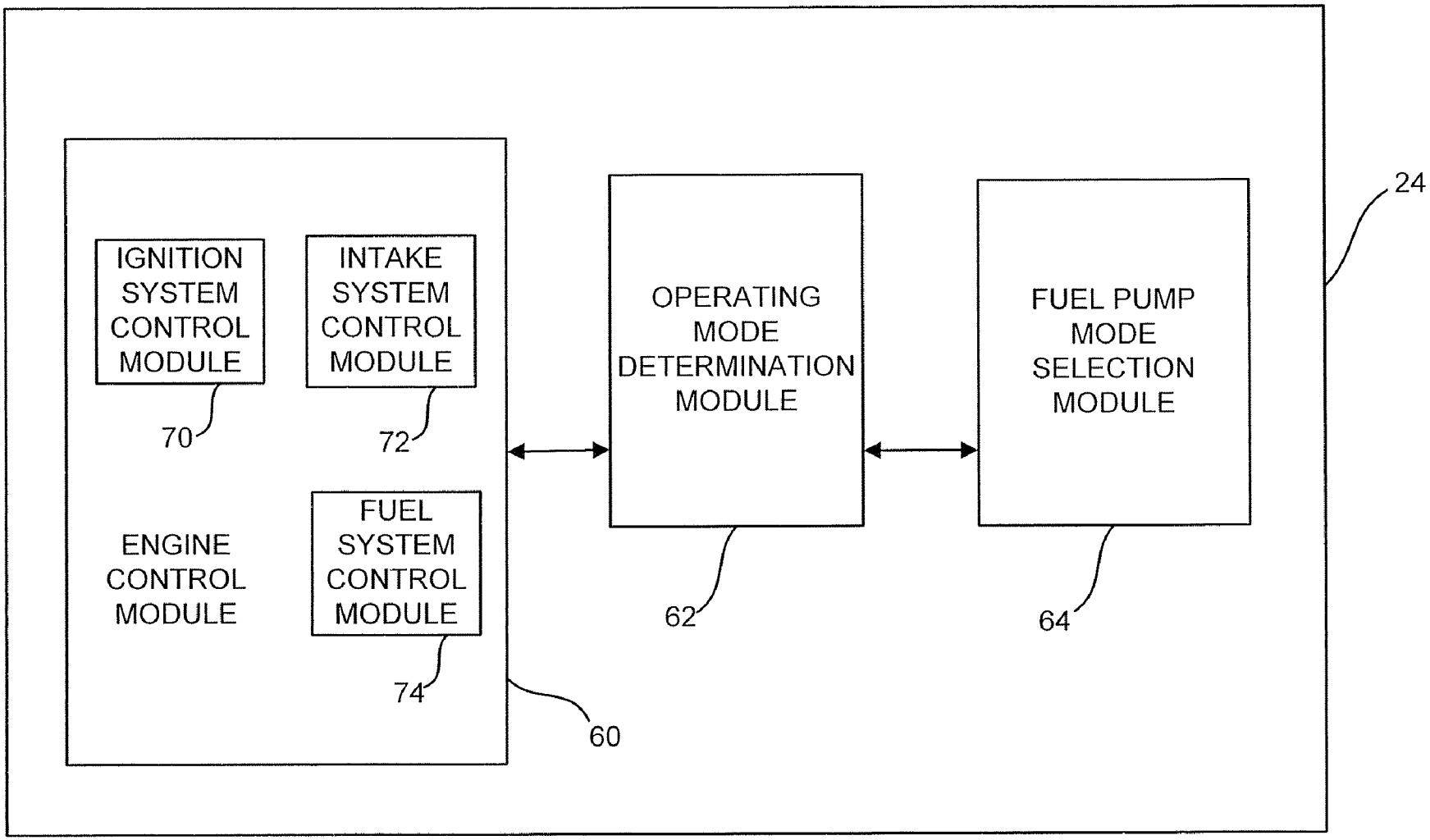
FIG. 5 is a block diagram of a control module for a vehicle.

Referring now to FIG. 5, control module 24 may include engine control module 60, operating mode determination module 62, and fuel pump mode selection module 64. Engine control module 60 may include ignition system control module 70, intake system control module 72, and fuel system control module 74. Operating mode determination module 62 may be in communication with fuel pump mode selection module 64 and engine control module 60. Operating mode determination module 62 may monitor or receive parameters from engine control module 60 or other components of vehicle 10 that may be in communication with control module 24. Based on the status of monitored or received parameters, operating mode determination module 62 may communicate an operating mode status to fuel pump mode selection module 64 and engine control module 60.

Fuel pump mode selection module 64 may receive an operating mode status from operating mode determination module 62 and may be in communication with selection mechanism 50 and fuel pump 16 to select a mode for fuel pump 16. Engine control module 60 may be in communication with engine 12, ignition system control module 70 may be in communication with ignition system 34, intake system control module 72 may be in communication with intake system 30, and fuel system control module 74 may be in communication with fuel system 14 and components thereof such as fuel pump 16, fuel rail 18 and injection system 20. Engine control module 60, ignition system control module 70, intake system control module 72, and fuel system control module 74 may provide fuel, air, and ignition to engine 12 based on driver inputs, monitored and received parameters from components of vehicle 10, and an operating mode as determined by operating mode determination module 62.

Figure 6:
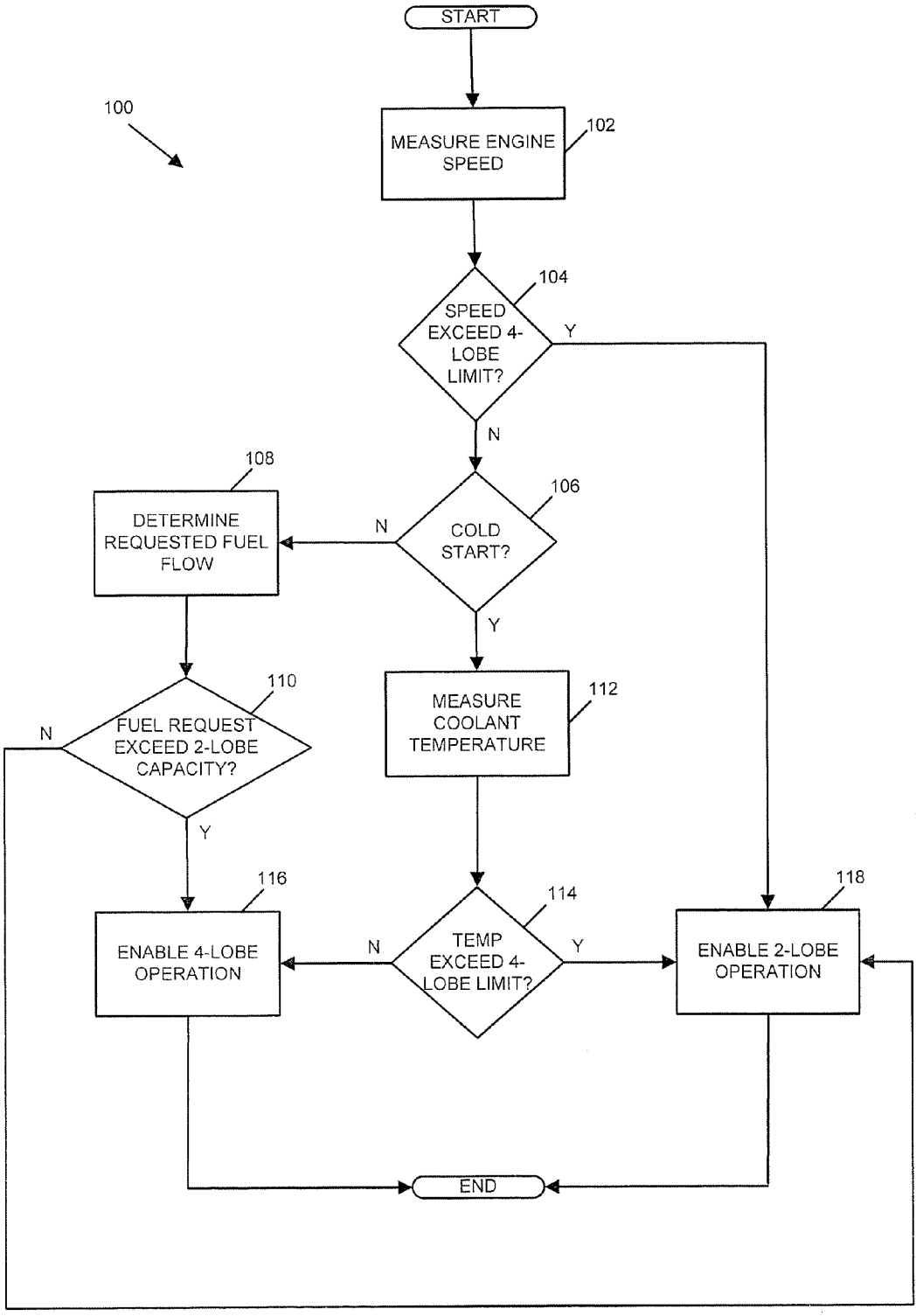
FIG. 6 is a flow diagram describing the steps in high pressure pump actuation in a vehicle.

Referring now to FIG. 6, a flowchart illustrates control logic 100. At block 102, engine control module 60 may determine the engine speed. Control logic 100 may then continue to block 104. At block 104, operating mode determination module 62 may receive the determined engine speed and may compare the determined engine speed to a 4-lobe limit. A 4-lobe limit may be based on an engine speed at which a no-follow condition may occur such that 4-lobe outer cams 40 and 44 and follower 48 may not engage properly. For example, outer spring 58 may not provide enough force when the outer cams 40 and 44 are rotating at a high speed. For example, the 4-lobe limit may be based on an engine speed at which a no-follow condition occurs, such as 2500 rpm or greater. If operating mode determination module 62 determines that the measured engine speed exceeds the 4-lobe limit, control logic 100 may continue to block 118. If the measured engine speed does not exceed the 4-lobe of limit, control logic 100 may continue to block 106.

At block 106, engine control module 60 may determine from monitored or measured engine parameters whether a vehicle cold start condition exists and communicate that information to operating mode determination module 62. A cold start condition may include when engine 12 has not been started for an extended period of time. If a cold start condition exists, control logic 100 may continue to block 112. If a cold start condition does not exist, control logic 100 may continue to block 108.

At block 112, engine control module 60 may determine a coolant temperature based on monitored or received perimeters. Control logic 100 may then continue to block 114. At block 114, operating mode determination module 62 may receive a coolant temperature from engine control module 60 and determine whether the temperature measured at block 112 exceeds a 4-lobe limit. A 4-lobe limit may be based on a coolant temperature that indicates that the engine 12 is not in a cold-start condition. If operating mode determination module 62 determines that the coolant temperature does not exceed the 4-lobe limit, the control logic 100 may continue to block 116. If operating mode determination module 62 determines that the coolant temperature does exceed the 4-lobe limit, control logic 100 may continue to block 118.

If at block 106 engine control module 60 has determined that a cold start condition does not exist, control logic 100 may continue to block 108 where engine control module 60 and/or fuel system control module 74 may determine a requested fuel flow from monitored or received perimeters. Control logic 100 may continue to block 110 where operating mode control module 62 may determine whether the amount of fuel requested for operation of engine 12 exceeds the capacity of 2-lobe inner cam 42. If operating mode determination module 62 determines that the fuel requested exceeds the 2-lobe capacity, control logic 100 may continue to block 116. If operating mode determination module 62 determines that the requested fuel does not exceed the 2-lobe capacity, control logic 100 may continue to block 118.

Based on the operation of control logic 100, block 118 may be reached if the engine speed exceeds the 4-lobe limit at block 104, if a cold start condition exists at block 106 but the coolant temperature exceeds a 4-lobe limit at block 114, or if a cold start condition does not exist at block 106 and the requested fuel does not exceed a 2-lobe capacity at block 110.

At block 118 operating mode determination module 62 may communicate that 2-lobe operation is enabled to fuel pump mode selection module 64 and engine control module 60. Fuel pump mode selection module 64 may communicate with fuel pump 16 such that selection mechanism 50 may allow inner follower 52 of follower 48 to engage 2-lobe inner cam 42. Follower 48 may be displaced to fully stroke the piston of fuel pump 16 twice per revolution of shaft 46 and 2-lobe inner cam 42.

Engine control module 60, ignition system control module 70, intake system control module 72, and fuel system control module 74 may control engine 12, ignition system 34, intake system 30 and fuel system 14 to operate based on a fuel pump capacity for 2-lobe operation. Once 2-lobe operation is enabled at block 118, control logic 100 may end.

Control logic 100 may reach block 116 if the measured engine speed does not exceed the four-lobe limit at block 104, and a requested fuel flow exceeds the 2-lobe capacity at block 110 in a non-cold start condition from block 106, or if a cold start condition exists at block 106 and the coolant temperature does not exceed a 4-lobe limit at block 114.

At block 116 operating mode determination module 62 may communicate that four-lobe operation is enabled to engine control module 60 and fuel pump mode selection module 64. Fuel pump mode selection module 64 may communicate with fuel pump 16 such that selection mechanism 50 may allow outer follower 54 of follower 48 to engage 4-lobe outer cams 40 and 44. Follower 48 may be displaced to fully stroke the piston of fuel pump 16 four times per revolution of the 4-lobe outer cams 40 and 44.

Engine control module 60, ignition system control module 70, intake system control module 72, and fuel system control module 74 may control engine 12, ignition system 34, intake system 30 and fuel system 14 to operate based on a fuel pump capacity for 4-lobe operation. Once 4-lobe operation is enabled at block 116, control logic 100 may end.

Those skilled in the art can now appreciate from the foregoing description that the broad teachings of the present disclosure can be implemented in a variety of forms. Therefore, while this disclosure has been described in connection with particular examples thereof, the true scope of this disclosure should not be so limited since other modification will become apparent to the skilled practitioner upon a study of the drawings, the specification and the following claims.

What is claimed is:

1. A drive system comprising:

a shaft in rotational engagement with a crankshaft of an engine, the shaft including:

a first cam affixed about a radial surface of the shaft and having a first quantity of lobes, the first cam selectively engageable to a follower; and a second cam affixed about the radial surface of the shaft and having a second quantity of lobes greater than the first quantity of lobes, the second cam longitudinally spaced apart from the first cam along the shaft and selectively engageable to the follower; and a selection mechanism that engages the follower to at least one of the first cam and the second cam.

2. The drive system of claim 1, wherein the first cam has two lobes.

3. The drive system of claim 2, wherein the second cam has four lobes.

4. The drive system of claim 2, wherein the first cam has a substantially oval profile.

5. The drive system of claim 1, further comprising a fuel pump coupled to the follower.

6. The drive system of claim 5, wherein the fuel pump is a piston pump.

7. The drive system of claim 5, wherein the selection mechanism is integral to the fuel pump.

8. A method comprising:

rotating a shaft having a first cam and a second cam, the first and second cams affixed about a radial surface of the shaft and longitudinally spaced apart along the shaft, the first and second cams selectively engageable to a fuel pump of a vehicle;

monitoring operating parameters of the vehicle; and operating the fuel pump at a desired capacity based on the monitoring, including engaging the fuel pump to at least one of the first cam and the second cam.

9. The method of claim 8, wherein the first cam has a first quantity of lobes and the second cam has a second quantity of lobes greater than the first quantity of lobes.

10. The method of claim 9, wherein the first quantity of lobes is two and the second quantity of lobes is four.

11. The method of claim 9, wherein the operating parameters include at least one of an engine speed, a coolant temperature, a cold start status, and a requested fuel amount.

12. The method of claim 11, wherein the operating includes engaging the fuel pump to the first cam when the engine speed exceeds a predetermined maximum engine speed.

13. The method of claim 11, wherein the operating includes engaging the fuel pump to the second cam when the requested fuel amount exceeds a predetermined fuel capacity for the first cam.

14. A method comprising:

rotating a shaft having a first cam and a second cam, the first cam having a first quantity of lobes and the second cam having a second quantity of lobes greater than the first quantity of lobes, the first and second cams selectively engageable to a fuel pump of a vehicle;

monitoring operating parameters of the vehicle, the operating parameters including at least one of an engine speed, a coolant temperature, a cold start status, and a requested fuel amount; and operating the fuel pump at a desired capacity based on the monitoring, including engaging the fuel pump to one of the first cam and the second cam, wherein the operating further includes engaging the fuel pump to the second cam when the vehicle is at a cold start and the coolant temperature does not exceed a predetermined maximum coolant temperature for the second cam.

15. The method of claim 8, wherein the fuel pump is a piston pump.

16. A control module comprising:

an operating mode determination module monitoring operating parameters of a vehicle and determining a capacity of a fuel pump; and a fuel pump mode selection module in communication with the operating mode determination module that engages the fuel pump to at least one of a first cam and a second cam selectively engageable to the fuel pump, wherein the first and second cams are affixed about a radial surface of a rotatable shaft and longitudinally spaced apart along the shaft.

17. The control module of claim 16, wherein the first cam has a first quantity of lobes and the second cam has a second quantity of lobes greater than the first quantity of lobes.

18. The control module of claim 17, wherein the first quantity of lobes is two and the second quantity of lobes is four.

19. The control module of claim 17, wherein the operating mode determination module determines the capacity based on operating parameters including one of an engine speed, a coolant temperature, a cold start status, and a requested fuel amount.

20. The control module of claim 19, wherein the fuel pump selection module engages the fuel pump to the first cam when the engine speed exceeds a predetermined maximum engine speed.

21. The control module of claim 19, wherein the fuel pump selection module engages the fuel pump to the second cam when the requested fuel amount exceeds a predetermined fuel capacity for the first cam.

22. A control module comprising:

an operating mode determination module that monitors operating parameters of a vehicle and determines a capacity of a fuel pump based on the operating parameters, the operating parameters including at least one of an engine speed, a coolant temperature, a cold start status, and a requested fuel amount; and a fuel pump mode selection module in communication with the operating mode determination module that engages the fuel pump to one of a first cam and a second cam selectively engageable to the fuel pump, the first cam having a first quantity of lobes and the second cam having a second quantity of lobes greater than the first quantity of lobes, wherein the fuel pump mode selection module engages the fuel pump to the second cam when the vehicle is at a cold start and the coolant temperature does not exceed a predetermined maximum coolant temperature for the second cam.

23. The control module of claim 16, wherein the fuel pump is a piston pump.

* * * * *